US005848912A

United States Patent [19]

Okabe

[11] Patent Number: 5,848,912

[45] Date of Patent: Dec. 15, 1998

[54] HALF-FITTING PREVENTION CONNECTOR

[75] Inventor: Toshiaki Okabe, Shizuoka, Japan

[73] Assignee: Yazaki Corporation, Tokyo, Japan

[21] Appl. No.: 811,968

[22] Filed: Mar. 5, 1997

[30] Foreign Application Priority Data

Mar. 7, 1996 [JP] Japan ..... 8-050455

[51] Int. Cl.[6] ..... H01R 3/00

[52] U.S. Cl. ..... 439/489; 439/310; 439/352

[58] Field of Search ..... 439/188, 352–357, 439/488, 489, 310

[56] References Cited

U.S. PATENT DOCUMENTS 5,338,227 8/1994 Nakamura ..... 439/352 X
5,370,543 12/1994 Hamada et al. ..... 439/188
5,376,014 12/1994 Sumida ..... 439/352 X

*Primary Examiner*—Khiem Nguyen
*Attorney, Agent, or Firm*—Sughrue, Mion, Zinn, Macpeak & Seas, PLLC

[57] ABSTRACT

A female connector 1, constituting a half-fitting prevention connector of the invention, has a slider receiving portion 4 for receiving and holding a slider 10. Positioning guide grooves 5 for positioning and supporting the slider 10 are provided respectively on opposite sides of the slider receiving portion 4. A lock arm 6, having an elastically-deformable arm portion 8, is provided above the slider receiving portion 4. A lock beak 7 for retaining the slider 10 is formed on an upper surface of the lock arm 6. The slider 10 includes an elastically-deformable slider arm 14 for retaining the lock beak 7, support projections 17 formed respectively on opposite sides of a base portion 11 for fitting respectively into the positioning guide grooves 5, and a spring receiving portion 12 for receiving a compression spring 9. A receiving space 16 for receiving the lock arm 6 is formed between the slider arm 14 and the base portion 11.

8 Claims, 14 Drawing Sheets

HALF-FITTING PREVENTION CONNECTOR

BACKGROUND OF THE INVENTION

1. Field of the Invention

This invention relates to a half-fitting prevention connector in which a condition of half-fitting between a pair of male and female connectors to be fitted and connected together is prevented by resiliency of a resilient member mounted in a housing of one of the two connectors, and the connector can be easily fitted relative to the mating connector.

2. Related art

Many electronic devices for various controls are mounted on a current automobile, and naturally many wire harnesses and flat cables are used. Automobiles are used in a severe environment in which the automobile is subjected to vibration and submerging. Therefore, in view of an assembling process and the maintenance, half-fitting prevention connectors with a waterproof function have been used to easily connect and disconnect wires such as wire harnesses.

Various half-fitting prevention connectors are known, and for example, Japanese Utility Model Unexamined Publication No. 5-81967 discloses such a half-fitting prevention connector.

One example of a conventional half-fitting prevention connector will now be described with reference to FIGS. 16 and 17. A pin-type connector 50 has a plurality of pin contacts 52 arranged therein, and has a pair of mounting flanges 50*a* formed respectively at opposite sides thereof. A socket-type connector 51 has a plurality of socket contacts 53 arranged therein, and wires 53*a* are connected to the socket contacts 53, respectively.

The pin-type connector 50 includes a box-shaped housing 54 having an open front side, and a guide plate 55 for guiding the fitting of the socket-type connector 51 is mounted centrally of the height within the housing 54, and divides the interior of the housing 54 into an upper portion and a lower portion. As shown in FIG. 17, within the housing 54, the pin contacts 52 extend from a rear portion toward the front side of this housing. A notch is formed in a central portion of a top plate 54*b* of the housing 54, and a forwardly-directed engagement piece portion 56 is formed integrally with the top plate 54*b*, and is disposed in this notch. A distal end of the engagement piece portion 56 terminates short of the front edge of the top plate 54*b*, and can be slightly flexed outwardly. An inwardly-directed engagement projection 56*a* is formed on the distal end of the engagement piece portion 56.

The socket-type connector 51 includes a box-shaped housing 57, and has such a size as to be fitted into the opening in the housing 54 of the pin-type connector 50. Pin holes 58 for respectively receiving the pin contacts 52, and a slot 59 for receiving the guide plate 55 are provided in the front side of the housing 57.

A movable cover 60 is fitted on the housing 57 for movement back and forth, and covers the housing 57 except front and rear end portions thereof. An opening 61 for receiving the pin-type connector 50 is formed in the front side of the movable cover 60. The opening 61 has such a size as to receive opposite side plates 54*a*, the top plate 54*b* and a bottom plate 54*c* of the housing 54.

A pair of opposed spring receiving portions (not shown) are formed respectively at opposite side portions of the movable cover 60 and hence at opposite side portions of the housing 57, and springs 64 are received respectively in the spring receiving portions as indicated in broken lines in FIG. 16, each of the springs 64 extending in the forward-backward direction. The movable cover 60 is normally urged forward (that is, left in FIG. 16) by the springs 64, and is retained by slots 65, formed through an upper wall of the movable cover 60, and projections 66 formed on the upper surface of the housing 57. An engagement groove 67 is formed in the upper surface of the housing 57, and the engagement projection 56*a* of the engagement piece portion 56 is engaged in the engagement groove 67 when the two connectors are completely connected together. The engagement groove 67 is normally concealed by the movable cover 60, and appears when the movable cover 60 is moved.

When the two connectors 50 and 51 are fitted together, the pin contacts 52 contact the socket contacts 53, respectively, and the engagement projection 56*a* is engaged in the engagement groove 67, as shown in FIG. 17. In this fitted condition, the springs 64 are compressed, and the engagement piece portion 56 is covered by the movable cover 60, so that the engagement projection 56*a* can not be disengaged from the engagement groove 67, thereby positively maintaining the connected condition.

On the other hand, when the completely-fitted condition is not achieved, that is, a half-fitted condition is encountered, the distal end of the engagement piece portion 56 abuts against the edge of the opening in the movable cover 60, and the springs 64 are compressed. Therefore, the movable cover 60 presses the engagement piece portion 56 under the influence of the springs 64, and therefore the two connectors 50 and 51 are urged away from each other, and can not be fitted together at all.

As detection means for detecting the half-fitted condition without the use of the springs 64, for example, a connection detection device, disclosed in Japanese Patent Unexamined Publication No. 6-310220, is known.

As shown in FIGS. 18 and 19, a first connector housing 11 of the male type, having a plurality of through holes, and a second connector housing 12 of the female type are fitted and connected together. First contact connection electrode portions 1 of the female type are provided within the first connector housing 11, and second contact connection electrode portions 2 of the male type project into the second connector housing 12. Therefore, signals, transferred through wires 5, are fed through the first contact connection electrode portions 1 and the second contact connection electrode portions 2 to electrode portions on a circuit board.

A short-circuit spring 16 for short-circuiting specified ones of the first contact connection electrodes 1 together or releasing a short-circuited condition of specified electrodes 1 is provided within the first connector housing 1.]

A resilient, electrically-conductive member 25, comprising a pair of spring portions 25A and a connecting portion 25B interconnecting the spring portions 25A, is mounted on a movable engagement portion 20 of the first connector housing 11. The pair of spring portions 25A of the resilient, electrically-conductive member 25 are exposed to the upper side, and each spring portion 25A has a projection 26 for contact purposes at its central portion.

A pair of detection electrode members 28, corresponding respectively to the pair of spring portions 25A of the resilient, electrically-conductive member 25, project into the second connector housing 12 longer than the second contact connection electrode portions 2 in parallel relation to the distal end portions of the second contact connection electrode portions 2.

When the first and second connector housings 11 and 12 are properly fitted together as shown in FIG. 19, the distal ends of the second contact connection electrode portions 2 are fitted into and connected to the first contact connection electrode portions 1, respectively. At this time, the movable engagement portion 20, which has been pressed and deformed by engagement portions 30 as indicated in a dots-and-dash line, is restored into a condition indicated by a solid line, so that the two connector housings are completely fitted together, and at the same time the projections 26 of the pair of spring portions 25A of the resilient, electrically-conductive member 25 contact the detection electrode members 28, respectively. As a result, the pair of detection electrode members 28 forms a circuit through the resilient, electrically-conductive member 25, so that the properly mutually engaged condition can be electrically detected.

In the connectors 50 and 51 disclosed in the above Japanese Utility Model Unexamined Publication No. 5-81967, the half-fitting can be prevented. However, when the two connectors are to be fitted together while holding the opposite side surfaces of the movable cover 60 with the hand, the movable cover 60 fails to be moved, so that the fitting operation can not be achieved.

And besides, in the completely-fitted condition, the engagement piece portion 56 is not covered by the housing 57, and therefore when an external force acts on the movable cover 60, the movable cover 60 can be easily moved, so that the fitted condition of the connectors can be accidentally released.

Furthermore, it is necessary to provide the engagement piece portion 56 on the housing 54, which invites a problem that a material unable to be easily flexed can not be used.

In the connector housings 11 and 12 disclosed in the above Japanese Patent Unexamined Publication No. 6-310220, when the resilient, electrically-conductive material 25 contacts the detection electrode members 28, their contact surfaces do not slide relative to each other, which invites a problem that an insulating material (e.g. an oxide film), formed on the resilient, electrically-conductive member 25, can not be removed.

And besides, since the resilient, electrically-conductive member 25 is exposed, there is a fear that dust and the like deposit thereon to adversely affect the electrical conductivity.

SUMMARY OF THE INVENTION

It is an object of this invention to provide a half-fitting prevention connector in which a connector can be positively and easily fitted relative to a mating connector, and a half-fitted condition of the connector can be detected positively and easily.

The above object has been achieved by half-fitting prevention connectors described in the following paragraphs (1) to (8):

(1) A half-fitting prevention connector wherein a pair of female and male connectors are fitted and connected together, and a half-fitted condition of the two connectors is prevented by resiliency of a resilient member mounted within a housing of one of the two connectors, wherein a slide lock member is slidably supported by an elastically-deformable member, provided on the housing, and a support mechanism, and when fitting the one connector relative to the mating connector, the slide lock member cooperates with the resilient member to allow the elastically-deformable member to be elastically deformed so that the elastically-deformable member can be retainingly engaged with the mating connector.

(2) In the half-fitting prevention connector of the above paragraph (1), the slide lock member includes an elastically-deformable slider arm formed at a front section of an upper portion thereof, a press portion formed at a rear end portion of the upper portion, a spring-receiving portion formed in a rear end portion of a lower base portion, and a receiving space formed between the slider arm and the base portion for receiving the elastically-deformable member, the slider arm having a retaining portion.

(3) In the half-fitting prevention connector of the above paragraph (1) or paragraph (2), the elastically-deformable member is a lock arm which includes an elastically-deformable arm portion having a lock hole formed in a central portion thereof, and a lock beak which is formed on an upper surface thereof, and has a slanting surface, and a slider receiving portion for receiving the slide lock member is provided beneath the lock arm.

(4) In the half-fitting prevention connector of any one of the above paragraphs (1) to (3), the support mechanism is constituted by positioning guide grooves provided respectively on opposite sides of the slider receiving portion, and support projections formed respectively on opposite sides of the base portion of the slide lock member.

(5) In the half-fitting prevention connector of any one of the above paragraphs (1) to (4), the mating connector has a notch for receiving the slide lock member, and an abutment portion, against which a front end of the slider arm can abut, is formed on an upper surface of a housing of the mating connector at an end of the notch, and a lock beak for retaining the arm portion is formed on an inner surface of the housing of the mating connector.

(6) A half-fitting prevention connector wherein a pair of female and male connectors are fitted and connected together, and a half-fitted condition of the two connectors is prevented by resiliency of a resilient member mounted within a housing of one of the two connectors, wherein a slide lock member is slidably supported by an elastically-deformable member, provided on the housing, and a support mechanism, and when fitting the one connector relative to the mating connector, the slide lock member cooperates with the resilient member to allow the elastically-deformable member to be elastically deformed so that the elastically-deformable member can be retainingly engaged with the mating connector; and a fitting detection terminal for detecting a fitted condition of the connectors is fitted in the slide lock member.

(7) In the half-fitting prevention connector of the above paragraph (6), the mating connector has a fitting detection male terminal which can be electrically connected to the fitting detection terminal.

(8) In the half-fitting prevention connector of the above paragraph (6) or paragraph (7), the fitting detection terminal has a resilient contact portion for contact with the male terminal, and the contact portion is exposed to a lower side of the fitting detection terminal.

In the half-fitting prevention connector of the above paragraphs (1) to (5), when the female connector is pushed into the male connector in such a manner that the arm portion of the lock arm of the female connector is inserted into the notch in the male connector, the slider arm of the slide lock member abuts against the abutment portion on the male connector. Then, when the female connector is further pushed into the male connector, with the slide lock member held against movement, a space for allowing the flexing of the arm portion of the lock arm is formed, and the arm portion abuts against the lock beak, and is flexed downwardly. At this time, if this pushing operation is stopped, the female and male connectors are returned away from each other in their respective disengaging directions (opposite to their respective fitting directions) under the influence of the resilient member.

Then, when the female connector is further pushed, the arm portion slides over the lock-beak, and is retained by it, and also the slanting surface of the lock beak abuts against an edge of the opening in the slider arm, and when the female connector is further pushed, the slider is flexed upwardly. As a result of this flexing displacement, the slide lock member, which has been prevented by the abutment portion from forward movement, can move forward, and the slide lock member slidingly moves forward under the influence of the resilient member, and is returned to its initial position relative to the female connector. As a result of this movement, the space for the flexing of the arm portion is eliminated, so that the arm portion can not be flexed.

Therefore, the female and male connectors are completely fitted together, and the male terminals completely contact the female terminals, respectively. This completely-fitted condition can be detected by a sense of force obtained when the arm portion slides over the lock beak and by a sense of force obtained when the slider arm slides over the abutment portion, and also this completely-fitted condition can be detected by confirming the position of the returned slider with the eyes.

Therefore, in a half-fitted condition, the female and male connectors are moved away from each other by the resiliency of the resilient member, thereby preventing such a half-fitted condition, and besides the fitted condition can be easily detected by a sense of force obtained during the fitting operation and also by the position of the slide lock member. For fitting the two connectors together, this fitting operation can be carried out by holding the side wall of the female housing with the hand.

For releasing the fitted condition of the above half-fitting prevention connector, the female connector is pulled while applying a pressing force to the press portion of the slide lock member from the upper side, and as a result, the slider arm slidingly moves over the slanting surface of the abutment portion to be flexed upwardly, and slides over the abutment portion. Subsequently, the slider arm is brought into abutment against the slanting surface of the lock beak, thereby producing a force to flex the lock beak downwardly, and the space for the flexing of the arm portion of the lock arm is again formed. In this condition in which the arm portion is flexed and displaced downwardly, when the female connector, held by the hand, is pulled rearwardly, it is easily withdrawn from the male connector.

In the half-fitting prevention connector of the above paragraphs (6) to (8), the above effects are achieved, and in the completed-fitted condition, the fitting detection male terminal is inserted into a lower portion of the detection terminal, and contacts the contact portion to be short-circuited therewith. Therefore, the completely-fitted condition of the female and male connectors can be detected electrically.

The male terminal moves in sliding contact with the contact portion of the detection terminal, and therefore an oxide film or the like can be removed from those portions of the detection terminal and male terminal which contact each other. Therefore, an incomplete electrical conduction of the detection circuit due to an oxide film or the like is prevented.

And besides, since the detection terminal is received in the slide lock member, an incomplete electrical conduction due to the deposition of dust or the like is prevented.

BRIEF DESCRIPTION OF THE PREFERRED EMBODIMENTS

DETAILED DESCRIPTION OF THE PREFERRED EMBODIMENTS

Figure 1:
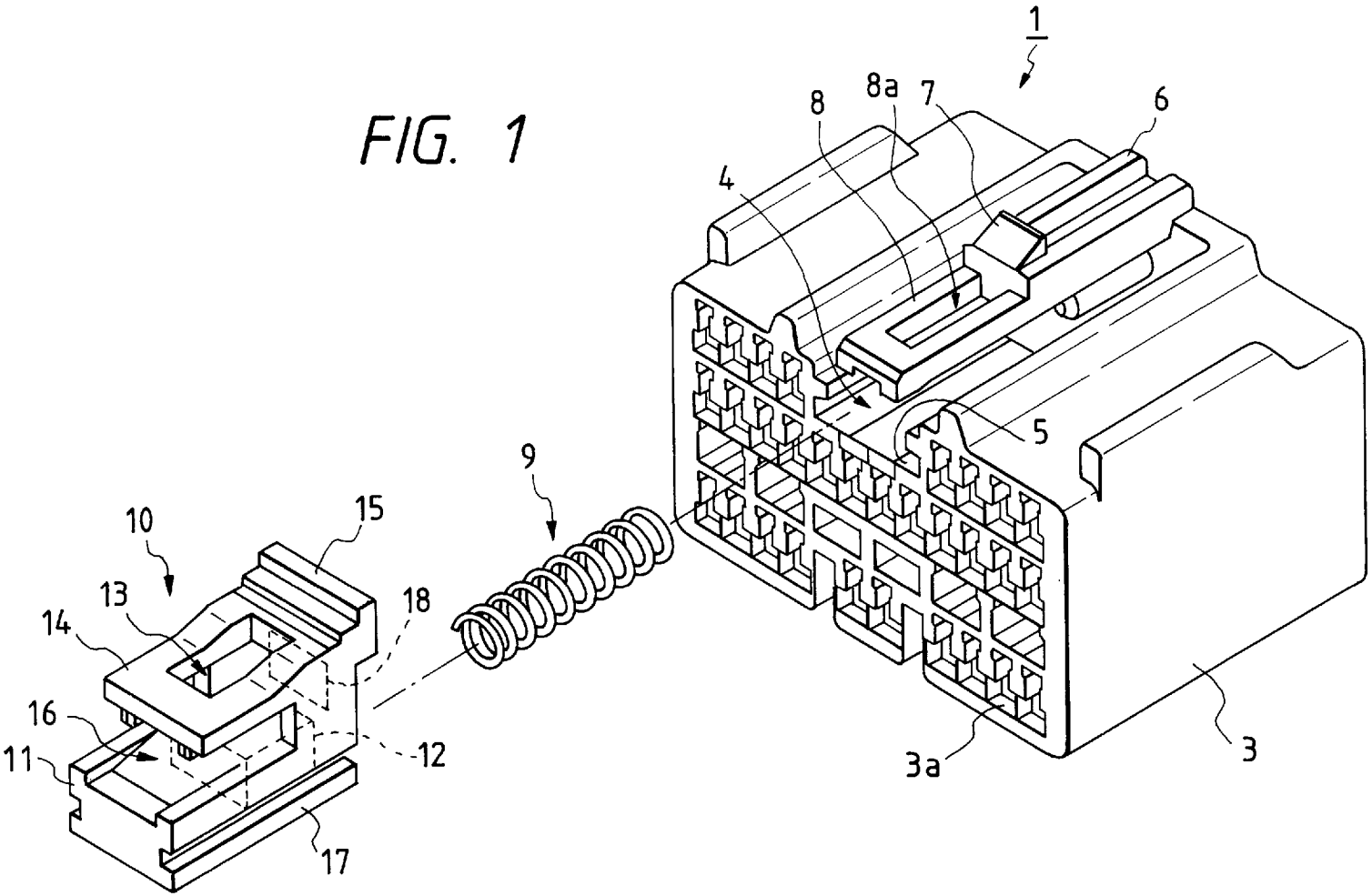
FIG. 1 is an exploded, perspective view showing a female connector and a lock member of a half-fitting prevention connector provided in accordance with one preferred embodiment of the invention.
Figure 3:
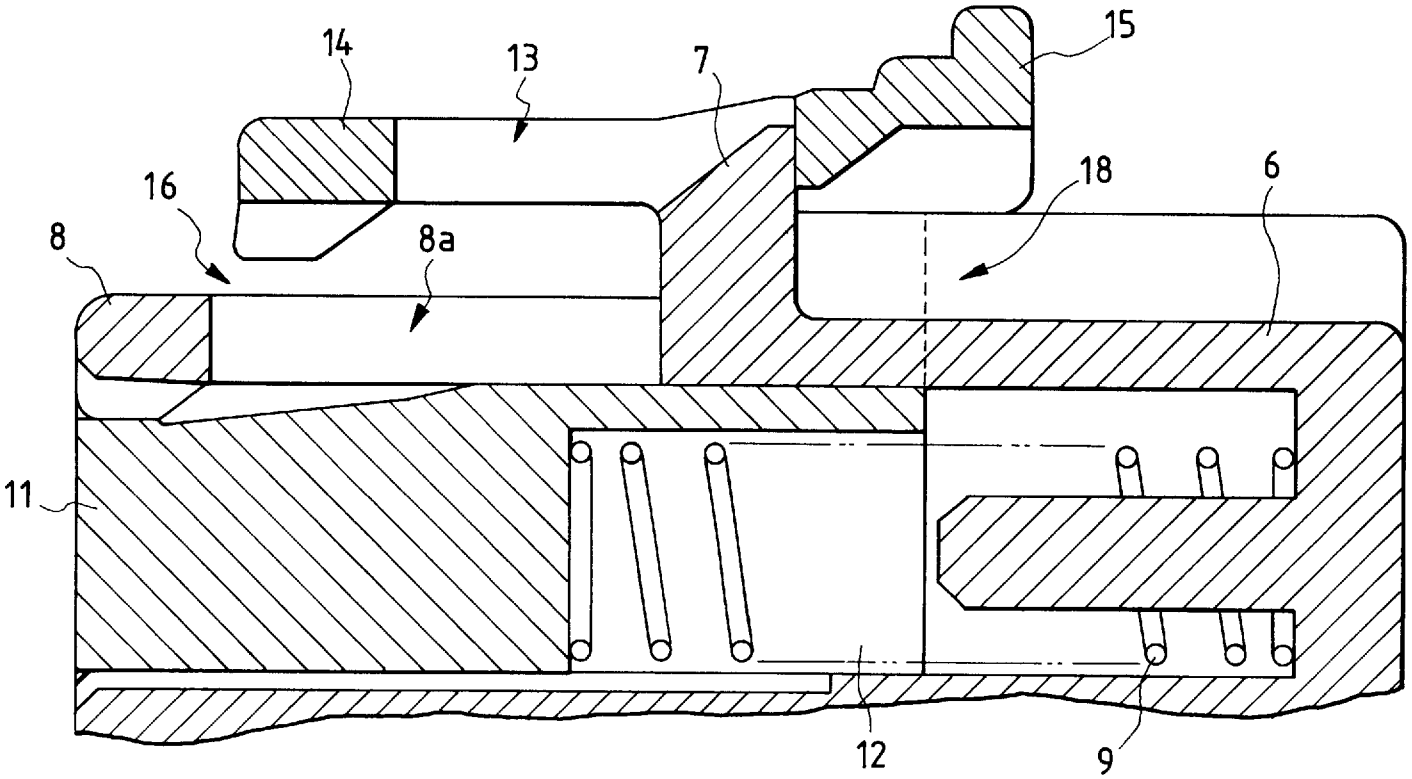
FIG. 3 is a cross-sectional view of an important portion taken along the line A—A of FIG. 2.
Figure 4:
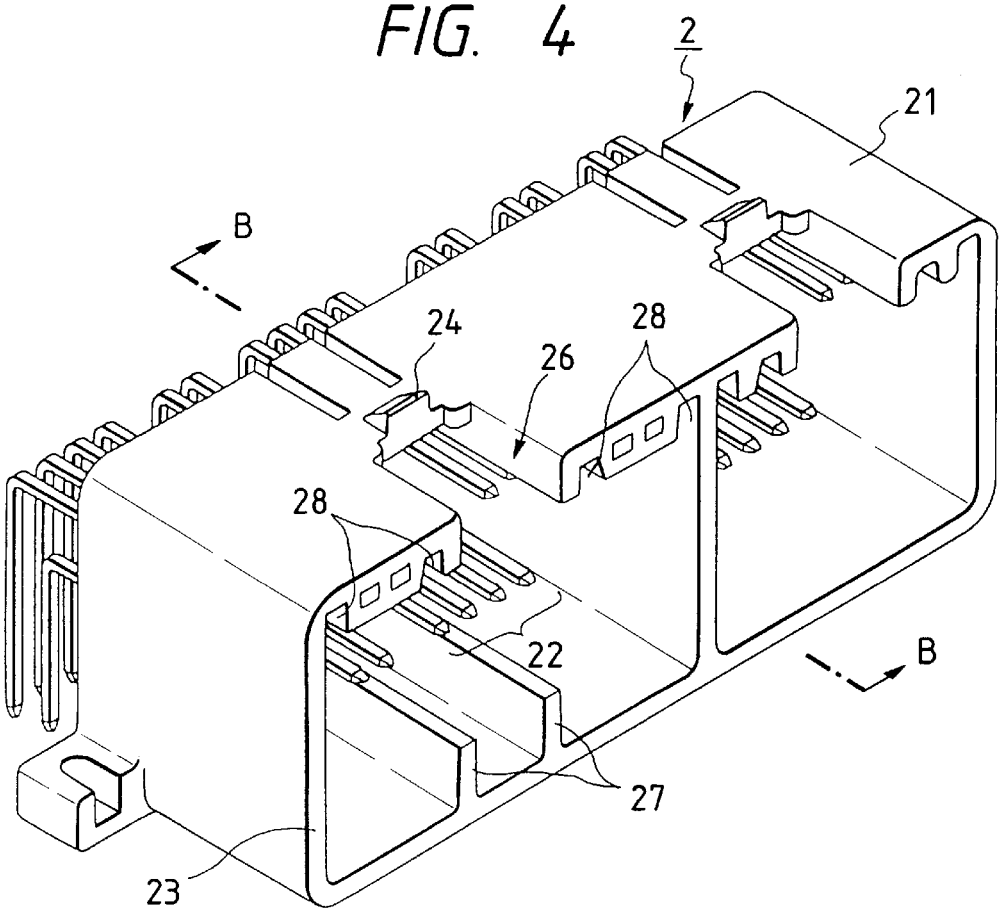
FIG. 4 is a perspective view of a male connector of the half-fitting prevention connector of the invention.
Figure 5:
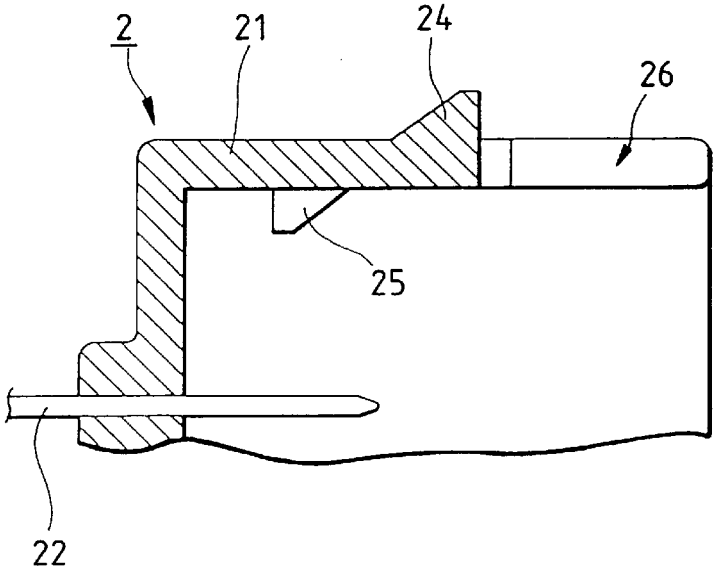
FIG. 5 is a fragmentary, cross-sectional view taken along the line B—B of FIG. 4.

Preferred embodiments of a half-fitting prevention connector of the present invention will now be described in detail with reference to FIGS. 1 to 15. FIG. 1 is an exploded, perspective view showing a female connector and a lock member of the half-fitting prevention connector provided in accordance with one preferred embodiment of the invention, FIG. 2 is a perspective view of the female connector, showing a condition in which the lock member of FIG. 1 is completely attached to the female connector, FIG. 3 is a cross-sectional view of an important portion taken along the line A—A of FIG. 2, FIG. 4 is a perspective view of a male connector of the half-fitting prevention connector of the invention, FIG. 5 is a fragmentary, cross-sectional view taken along the line B—B of FIG. 4, and FIGS. 6 to 9 are views showing a fitting operation of the female and male connectors.

As shown in FIG. 1, the female connector 1, constituting the half-fitting prevention connector of this embodiment, has a plurality of terminal receiving chambers 3*a* (each in the form of a through hole) formed in a housing 3, and a plurality of connection terminals are fitted in these terminal receiving chambers 3*a,* respectively. A slider receiving portion 4 for receiving and holding a slider (slide lock member) 10 is formed at an upper portion of the female connector housing 3. A pair of positioning guide grooves 5, serving as a positioning and supporting mechanism for the slider 10, are formed respectively at opposite sides of the slider receiving portion 4, and a lock arm 6, having an elastically-deformable arm portion 8 defined by its front portion, is provided above the guide grooves 5. The arm portion 8 has a lock hole 8*a* for retaining the slider 10 and also for locking a fitted condition of the female connector relative to the mating connector. A lock beak 7 for retaining the slider 10 is formed on an upper surface of the lock arm 6.

The slider 10 includes a press portion 15 which is provided at an upper portion thereof, and is pressed when releasing the fitted condition, and the slider 10 also includes an elastically-deformable slider arm 14 for retaining the lock beak 7, and the slider arm 14 extends forwardly from the press portion 15, and has a retaining hole 13 formed through a central portion thereof. Support projections 17 for fitting respectively in the positioning guide grooves 5 are formed respectively at opposite sides of a lower base portion 11 of the slider 10, and a spring receiving portion 12 for receiving a compression spring (resilient member) 9 is formed in the base portion 11, the spring receiving portion 12 being open to a rear end and a bottom surface of the slider. A receiving space 16 for receiving the lock arm 6 is formed between the slider arm 14 and the base portion 11. An insertion hole 18 for passing the lock arm 6 therethrough is formed in the rear end of the slider 10, and is disposed beneath the press portion 15, and the retaining hole 13, the receiving space 16 and the insertion hole 18 communicate with one another.

Figure 2:
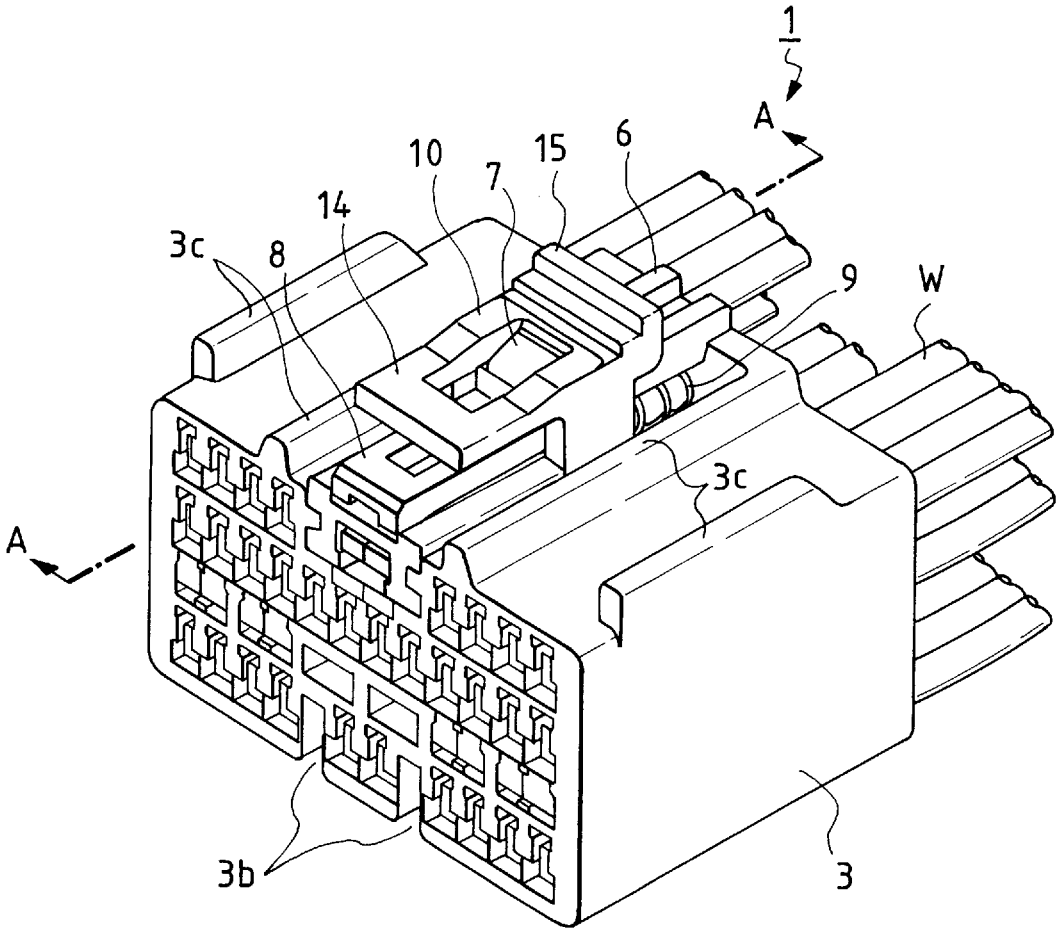
FIG. 2 is a perspective view of the female connector, showing a condition in which the lock member of FIG. 1 is completely attached to the female connector.

For attaching the slider 10 to the female connector 1, the compression spring 9 is first inserted into the slider receiving portion 4 from the front side of the female connector 1, and then the slider 10 is inserted into the slider receiving portion 4, with its rear side first introduced into the slider receiving portion 4, so that the lock arm 6 is passed through the insertion hole 18, thus achieving a completely-attached condition as shown in FIG. 2.

More specifically, as the slider 10 is inserted into the slider receiving portion 4 as shown in FIG. 3, the arm portion 8 of the lock arm 6 passes through the insertion hole 18, and a rear end of the press portion 15 abuts against a slanting surface of the lock beak 7, and when the slider 10 is further inserted or pushed, the elastically-deformable lock arm 6 is displaced downward. Then, when the slider is further inserted, the lock beak 7 is retained in the retaining hole 13 in the slider arm 14. At this time, part of the earlier-inserted compression spring 9 is received in the spring receiving portion 12.

The male connector 2 comprises a box-shaped housing 21, and a plurality of male terminals 22 each having one end portion of an L-shape, exposed at a rear side of the housing 21, and the other end portion projecting into the interior of the housing 21. The male terminals 22 are fixed respectively to predetermined positions of a rear wall of the housing 21, and the housing 21 has a hood portion 23 for receiving the mating connector. A notch 26 for receiving the lock arm 6 is formed in a top wall of the housing 21, and extends from a front edge of the housing 21 to a generally central portion of the top wall.

More specifically, as shown in FIG. 5, an abutment portion 24, against which the front end of the slider arm 14 can abut, is formed on that portion of the upper surface of the housing 21 disposed immediately adjacent to a rear end of the notch 26, and a lock beak 25 for retaining the arm portion 8 of the lock arm 6 is formed on the inner surface of the top wall facing away from the abutment portion 24.

The operation of fitting the female and male connectors 1 and 2 (which constitute the half-fitting prevention connector of this embodiment) together will now be described. For fitting the female connector 1 into the male connector 2, first, guide projections 3*c,* formed on the upper surface of the female connector 1 (shown in FIG. 2), are registered respectively with guide grooves 28 formed in the inner surface of the top wall of the male connector 2 (shown in FIG. 4), and also fitting grooves 3*b,* formed in the lower surface of the female connector 1, are registered respectively with fitting projections 27 formed on an inner surface of a bottom wall of the male connector 2, and in this condition the female connector 1 is pushed into the male connector 2.

Figure 6:
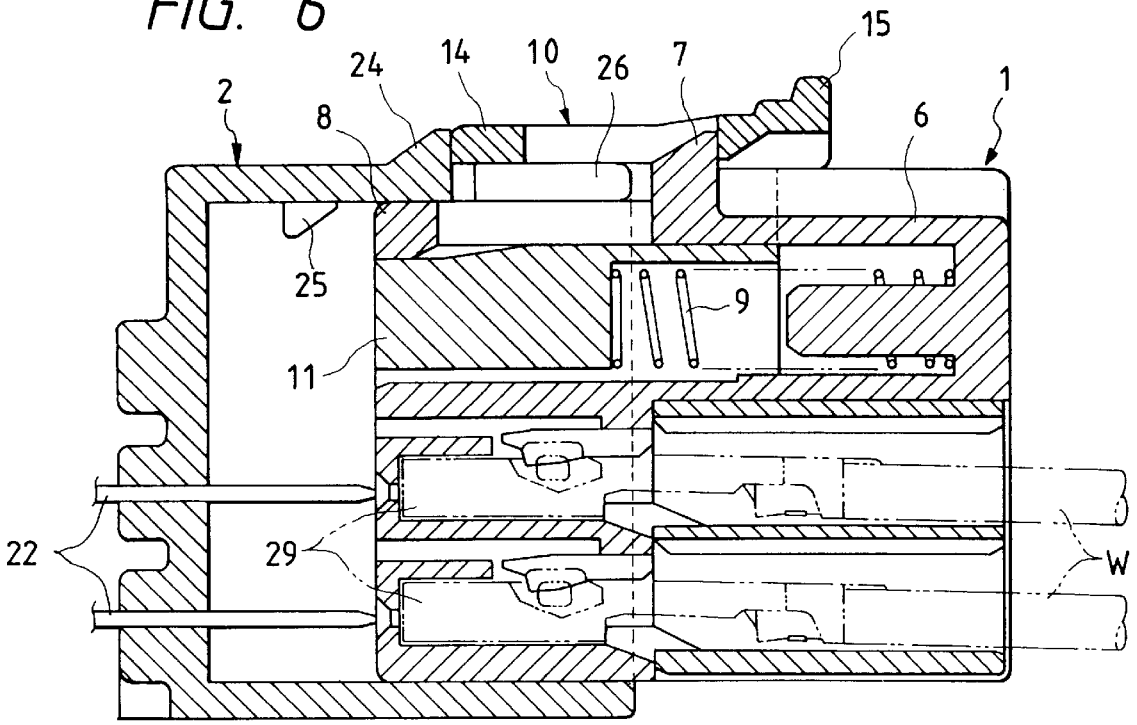
FIG. 6 is a view showing a condition in which a fitting operation of the female and male connectors is started.

As a result of this pushing operation, the arm portion 8 of the lock arm 6 of the female connector 1 is inserted into the notch 26 in the male connector 2, and the front end of the slider arm 14 of the slider 10, attached to the female connector 1, abuts against the abutment portion 24 of the male connector 2, as shown in FIG. 6. At this stage, the male terminals 22, mounted on the male connector 2, are not yet fitted respectively in the female terminals 29 (each connected to an end of a wire W) mounted on the female connector 1.

Then, the body of the female connector 1 is further pushed into the male connector 2, with the slider 10 held against movement. As a result of this movement, a space for allowing the flexing of the arm portion 8 of the lock arm 6 is formed, and the arm portion 8 abuts against the lock beak 25, and is flexed downwardly. At this stage, the male terminals 22 are fitted respectively in the female terminals 29, but are not completely electrically connected thereto, and when the pushing operation is stopped, the female and male connectors 1 and 2 are returned away from each other in their respective disengaging directions (opposite to their fitting directions) under the influence of the compression spring 9.

Figure 8:
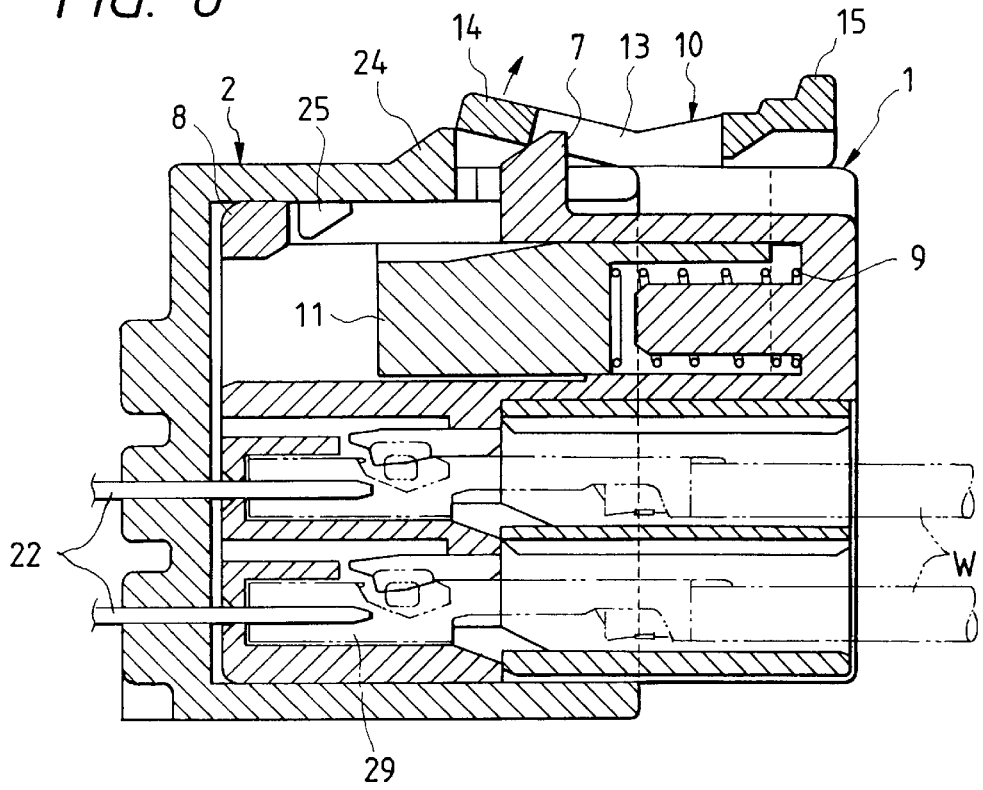
FIG. 8 is view showing a condition in which the fitting operation of FIG. 7 further proceeds.

In this condition, when the female connector 1 is further pushed into the male connector, the arm portion 8 slides over the lock beak 25, and is retained by it, and also the front edge of the retaining hole 13 (which is an edge of the opening in the slider arm 14), formed in the central portion of the slider arm 14, abuts against the slanting surface of the lock beak 7, as shown in FIG. 8, and when the female connector is further pushed, the slider arm 14 is flexed upwardly. As a result of this flexing displacement, the slider 10, which has been prevented by the abutment portion 24 from forward movement, can move forward. At this stage, the compression spring 9 is in a fully compressed condition, and if the pushing operation is stopped before the slider arm 14 is completely disengaged from the abutment portion 24, the female and male connectors 1 and 2 are returned away from each other in their respective disengaging directions by the maximum resilient force of the compression spring 9.

Figure 9:
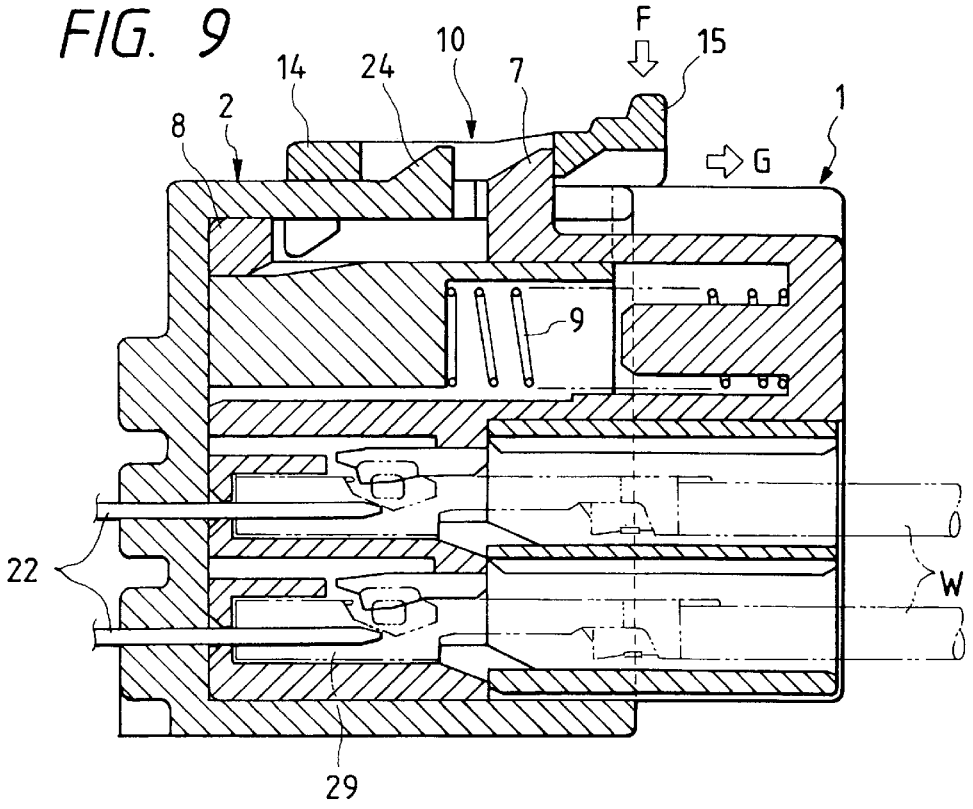
FIG. 9 is a view showing a condition in which the fitting operation of the female and male connectors in FIG. 8 is completed.

When the abutment of the slider arm 14 against the abutment portion 24 is released as shown in FIG. 9, the slider 10 is slidingly moved forward vigorously, and therefore is returned into its initial condition relative to the female connector 1. As a result, the space for allowing the flexing of the arm portion 8 of the lock arm 6 is eliminated. As a result of this movement, the female and male connectors 1 and 2 are completely fitted together, and the male terminals 22 completely contact the female terminals 29, respectively. This completely-fitted condition can be detected by a sense of force obtained when the arm portion 8 slides over the lock beak 25 and by a sense of force obtained when the slider arm 14 slides over the abutment portion 24, and also this completely-fitted condition can be detected by confirming the position of the returned slider 10 with the eyes.

For releasing the fitted condition of the above half-fitting prevention connector, the female connector is pulled in a direction of arrow G while applying a pressing force F to the press portion 15 of the slider 10 from the upper side, as shown in FIG. 9.

As a result, the slider arm 14 of the slider 10 slidingly moves over the slanting surface of the abutment portion 24 to be flexed upwardly as indicated by an arrow in FIG. 8, and slides over the abutment portion 24. Subsequently, the slider arm 14 is brought into abutment against the slanting surface of the elastically-deformable lock beak 7, thereby producing a force to flex the lock beak 7 downwardly, and the space for the flexing of the arm portion 8 of the lock arm 6 is again formed.

Figure 7:
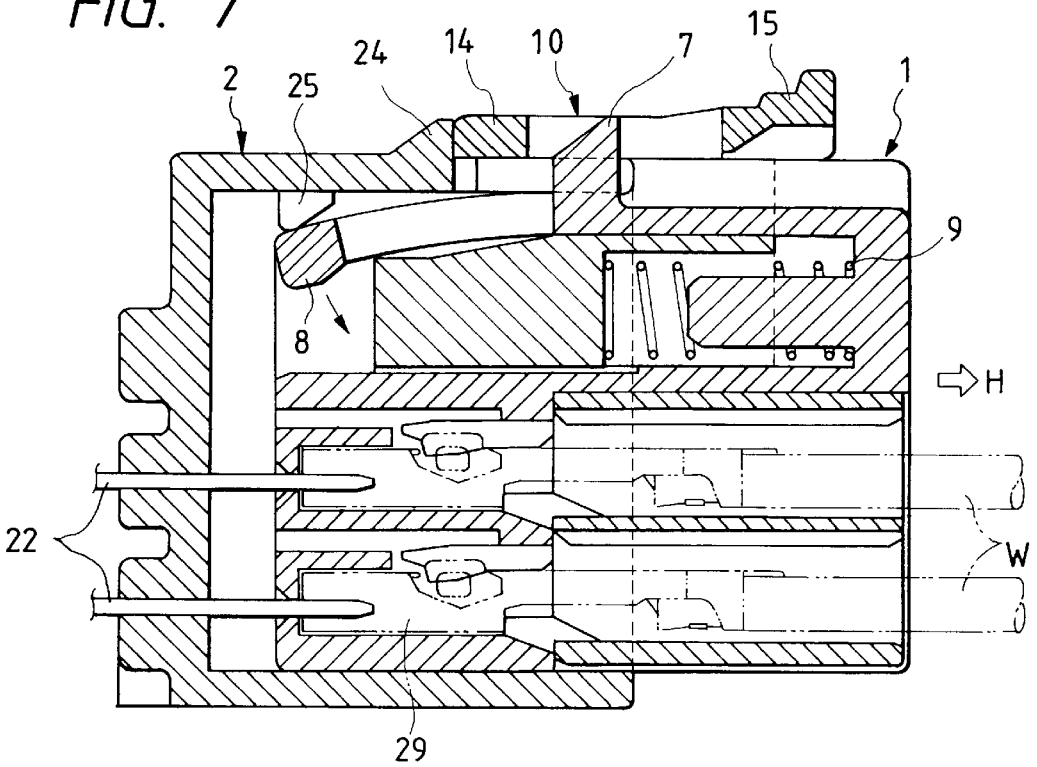
FIG. 7 is a view showing a condition in the process of the fitting operation of FIG. 6.

Then, as a result of the above operation, the arm portion 8 of the lock arm 6 is downwardly flexed and displaced as indicated by an arrow in FIG. 7. In this condition, when the female connector 1, held by the hand, is pulled rearwardly, it is easily withdrawn from the male connector 2. When the application of the pressing force to the press portion 15 is stopped in the completely-disconnected condition of the female connector 1, the slider 10 is automatically returned to its initial position under the influence of the compression spring 9.

Figure 10:
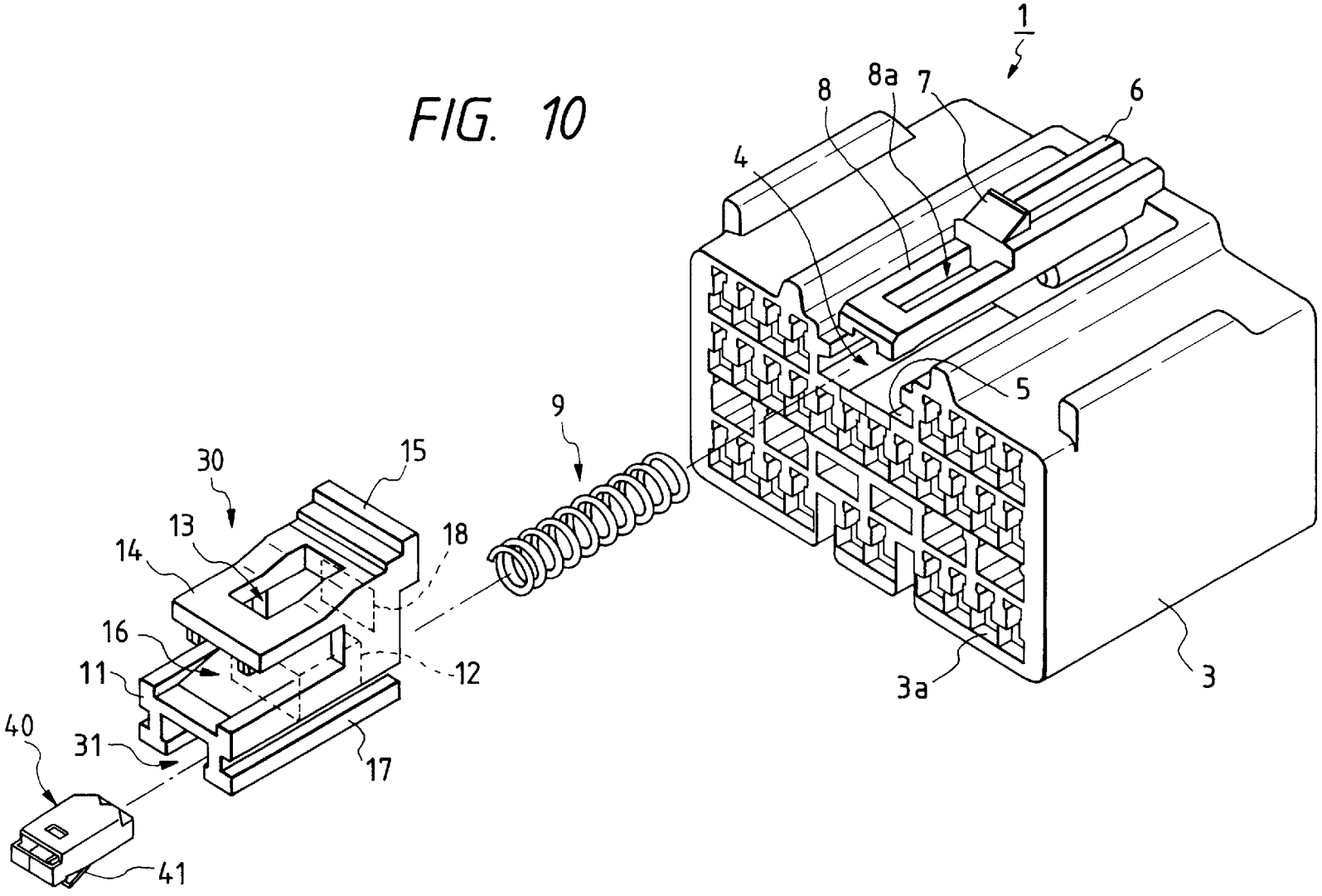
FIG. 10 is an exploded, perspective view showing a female connector and a lock member of a half-fitting prevention connector provided in accordance with another embodiment of the invention.
Figure 11:
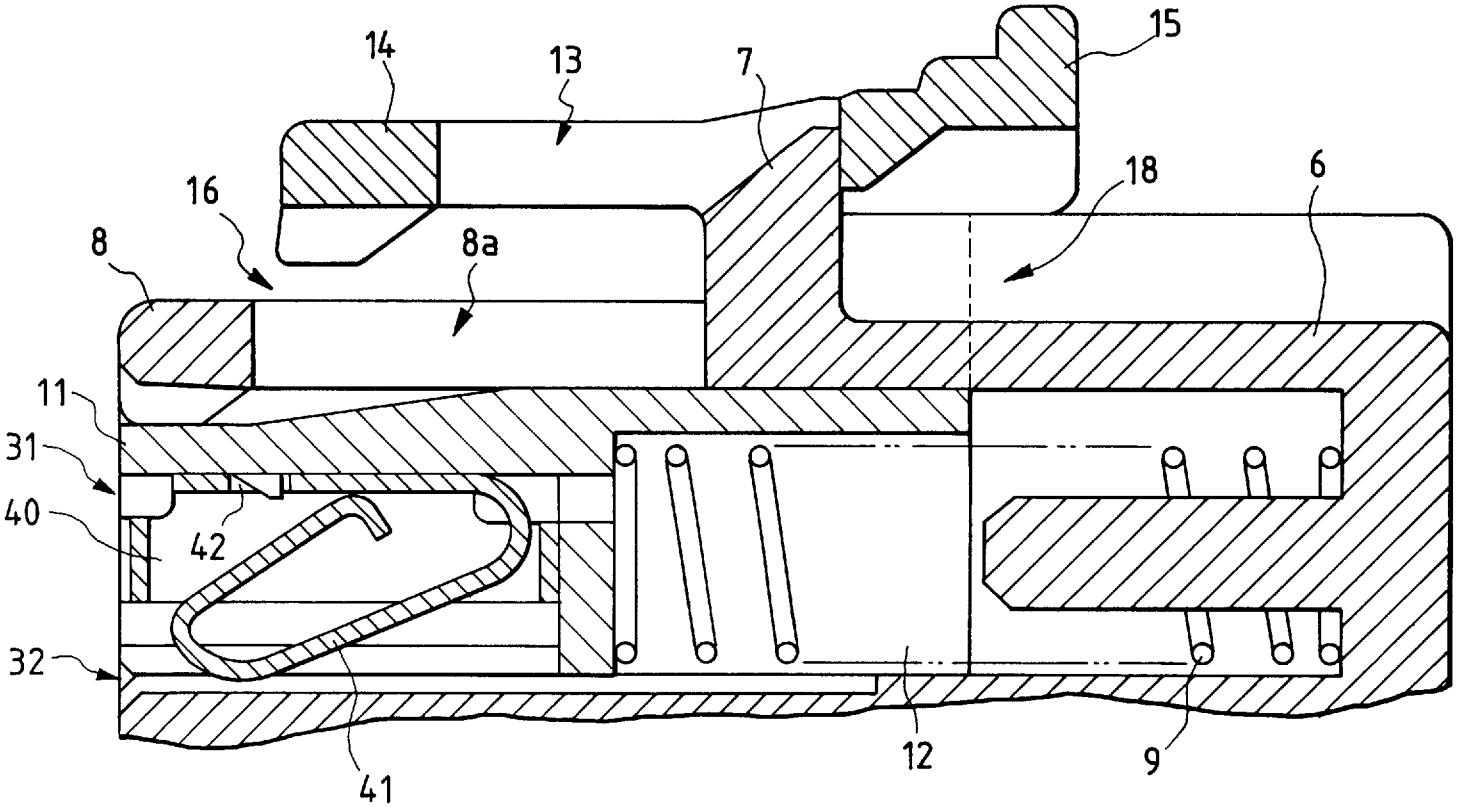
FIG. 11 is a cross-sectional view of an important portion of FIG. 10.

Next, another embodiment of a half-fitting prevention connector of the invention will be described in detail with reference to FIGS. 10 to 15. In the half-fitting prevention connector of this embodiment, a half-fitted condition is prevented by a resilient member, and this connector is provided with a detection function for electrically detecting a half-fitted condition. FIG. 10 is an exploded, perspective view showing a female connector and a lock member of the half-fitting prevention connector of this embodiment, FIG. 11 is a cross-sectional view of an important portion of FIG. 10, and FIGS. 12 to 15 are views showing a fitting operation of the female and male connectors. The same constituent members as those used in the above embodiments will be designated by the same reference numerals, respectively, and explanation thereof will be omitted.

As shown in FIG. 10, a slider 30, received in a slider receiving portion 4 of the female connector 1 constituting the half-fitting prevention connector of this embodiment, has a detection terminal receiving portion 31 formed in a front end portion of a lower base portion 11 of this slider, and this detection terminal receiving portion 31 is open to a front end and a bottom surface of the slider, and is isolated from a spring receiving portion 12. A fitting detection terminal 40 (described later) is received in the detection terminal receiving portion 31.

The fitting detection terminal 40, adapted to be fitted in the detection terminal receiving portion 31, is a female terminal of a generally box-shape, and has a resilient contact portion 41 which contacts a fitting detection male terminal (described later) when this male terminal is inserted into the fitting detection terminal 40, the resilient contact portion 41 being exposed to a lower side of the fitting detection terminal 40. The male terminal can contact the contact portion 41 to be short-circuited therewith, and through this contact, the condition of fitting of the female connector 1 in a male connector 2*a* can be electrically detected.

For attaching the fitting detection terminal 40 to the slider 30, the rear end of the fitting detection terminal 40 is inserted into the detection terminal receiving portion 31 through an opening in the front end of the base portion 11, and a retaining hole 42, formed in an upper surface of the detection terminal 40, is retainingly engaged with a retaining projection formed on an upper surface of the detection terminal receiving portion 31, thereby fixing the fitting detection terminal 40, as shown in FIG. 11.

Then, the slider 30, having the detection terminal 40, fitted therein, is inserted into the slider receiving portion 4 of the female connector 1, so that an insertion space 32 for receiving the fitting detection male terminal (described later) is formed at a lower portion of the slider receiving portion 4.

Figure 12:
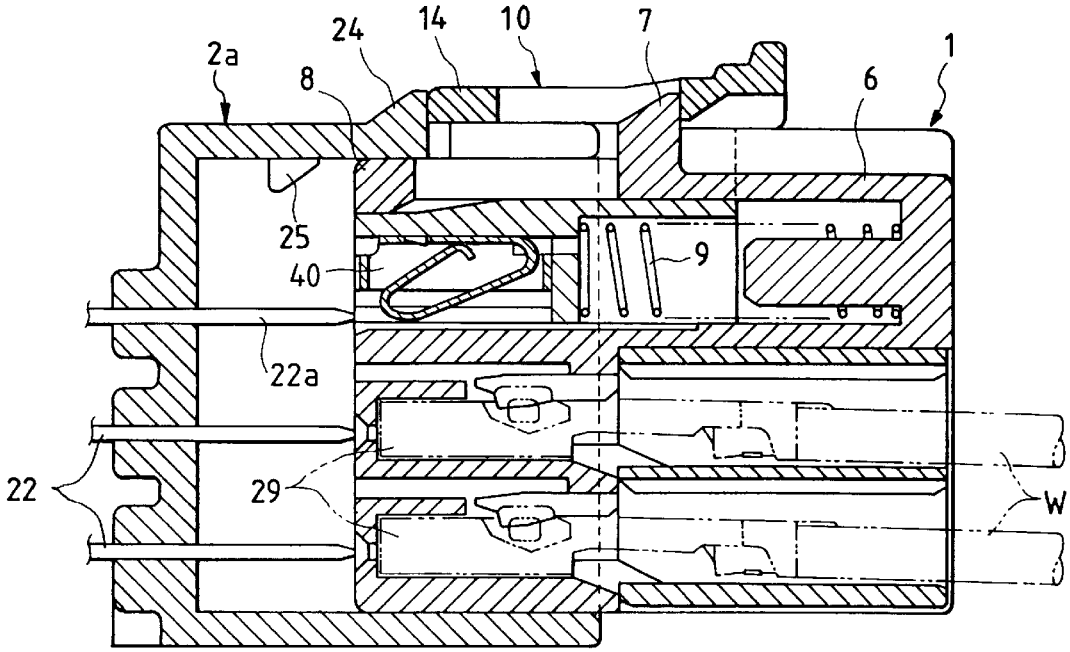
FIG. 12 is a view showing a condition in which the fitting operation of the female connector of FIG. 10 and a male connector is started.

As shown in FIG. 12, the male connector 2*a* has ordinary male terminals 22 to be electrically connected respectively to female terminals 29, and also has the fitting detection male terminal 22*a* for detecting the fitted condition of the female and male connectors 1 and 2*a,* the fitting detection male terminal 22*a* projecting above the plurality of male terminals 22.

The operation of fitting the female and male connectors 1 and 2*a* (which constitute the half-fitting prevention connector of this embodiment) together will now be described. Detailed explanation of the same operations as in the preceding embodiment will be omitted, and since the operation for releasing the fitting between the two connectors is the same as that of the preceding embodiment, explanation thereof will also be omitted.

As shown in FIG. 12, an arm portion 8 of a lock arm 6 of the female connector 1 is inserted into the male connector 2*a,* and a front end of a slider arm 14 of the slider 10 on the female connector 1 abutted against an abutment portion 24 of the male connector 2*a*. At this stage, the male terminals 22, mounted on the male connector 2*a,* are not yet fitted respectively in the female terminals 29 mounted on the female connector 1, and the fitting detection male terminal 22*a* is not yet fitted in the detection terminal 40.

Figure 13:
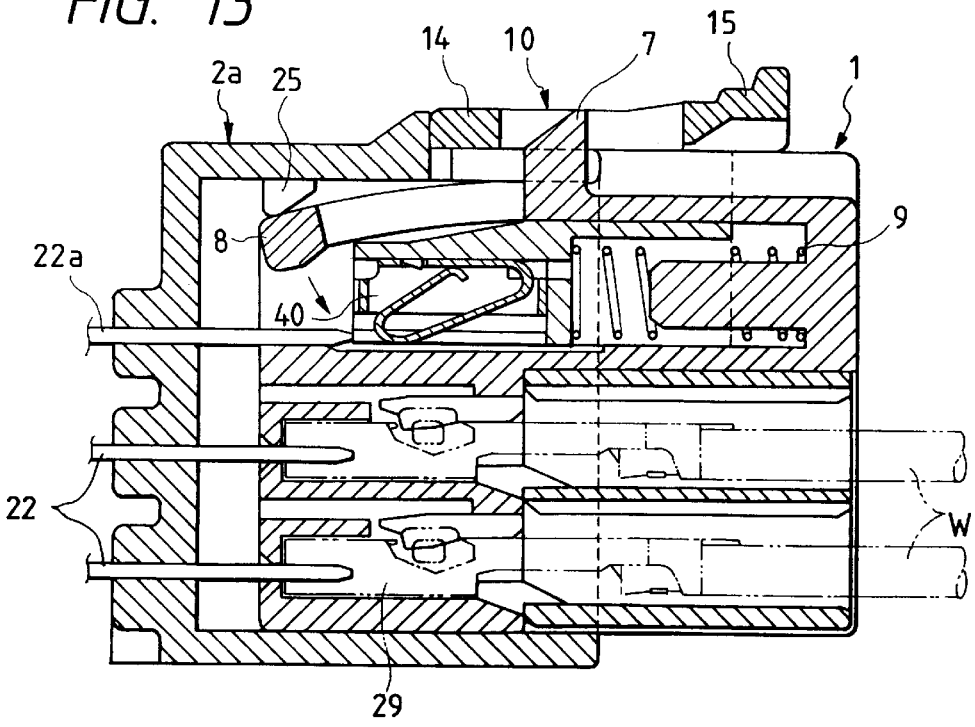
FIG. 13 is a view showing a condition in the process of the fitting operation of FIG. 12.

Then, as shown in FIG. 13, the body of the female connector 1 is further pushed into the male connector 2*a*. As a result, a space for allowing the flexing of the arm portion 8 is formed, and the arm portion 8 abuts against a slanting surface of a lock beak 25, and is flexed downwardly. At this stage, the male terminals 22 are fitted respectively in the female terminals 29, but are not completely electrically connected thereto, and when the pushing operation is stopped, the female and male connectors 1 and 2*a* are returned away from each other in their respective disengaging directions under the influence of a compression spring 9.

In this condition, the fitting detection male terminal 22*a* is not yet fitted in the detection terminal 40.

Figure 14:
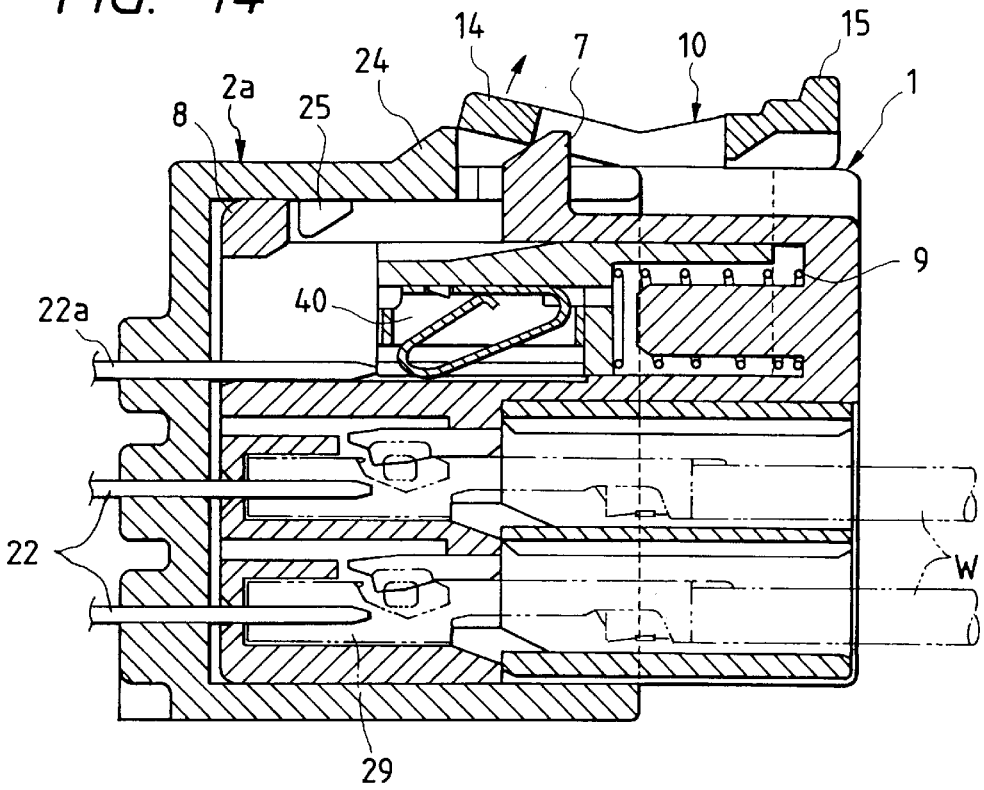
FIG. 14 is a view showing a condition in which the fitting operation of FIG. 13 further proceeds.

Then, when the female connector 1 is further pushed into the male connector as shown in FIG. 14, the arm portion 8 slides over the lock beak 25, and is retained by it, and also an edge of the opening in the slider arm 14 abuts against a slanting surface of a lock beak 7, and when the female connector is further pushed, the slider arm 14 is flexed upwardly. As a result, the slider 10 can move forward.

Figure 15:
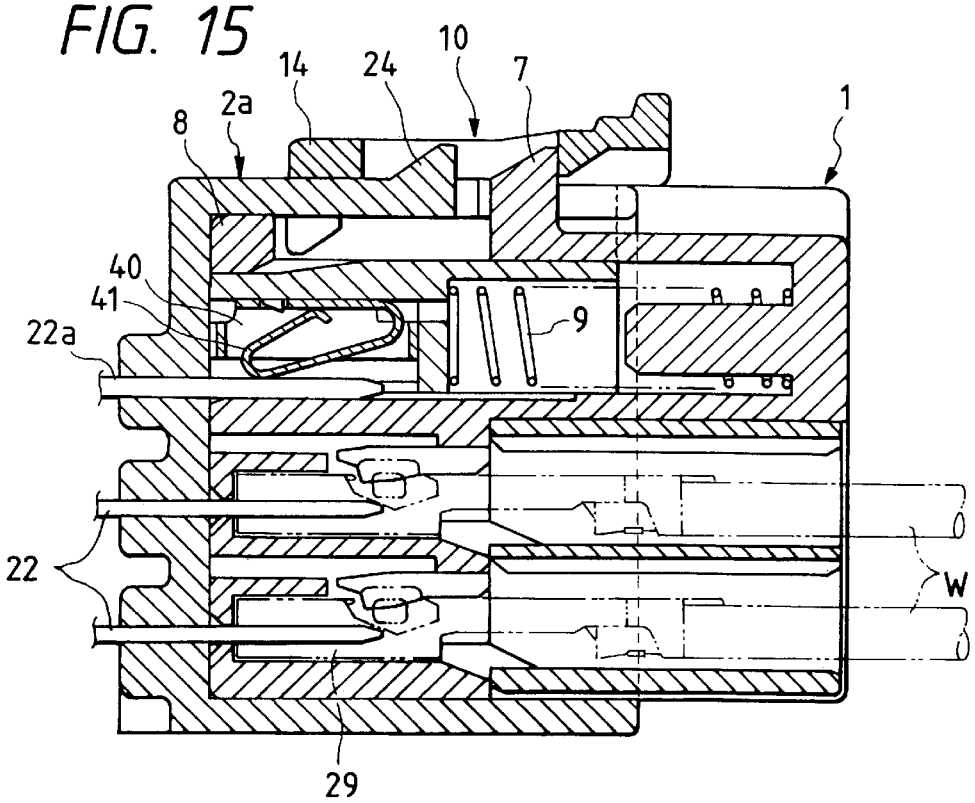
FIG. 15 is a view showing a condition in which the fitting operation of the female and male connectors in FIG. 14 is completed.
Figure 16:
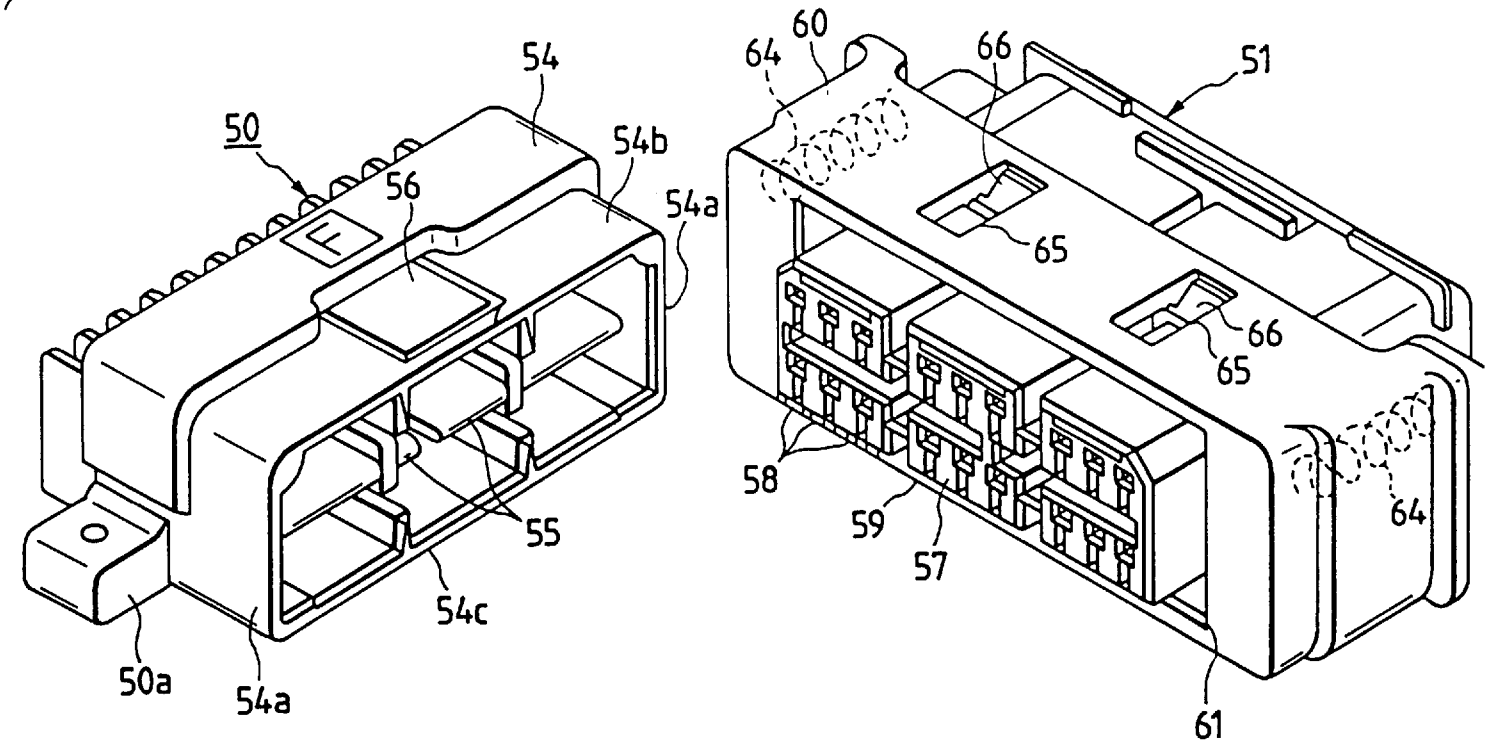
PRIOR ART FIG. 16
FIG. 16 is a perspective view of a conventional connector.
Figure 17:
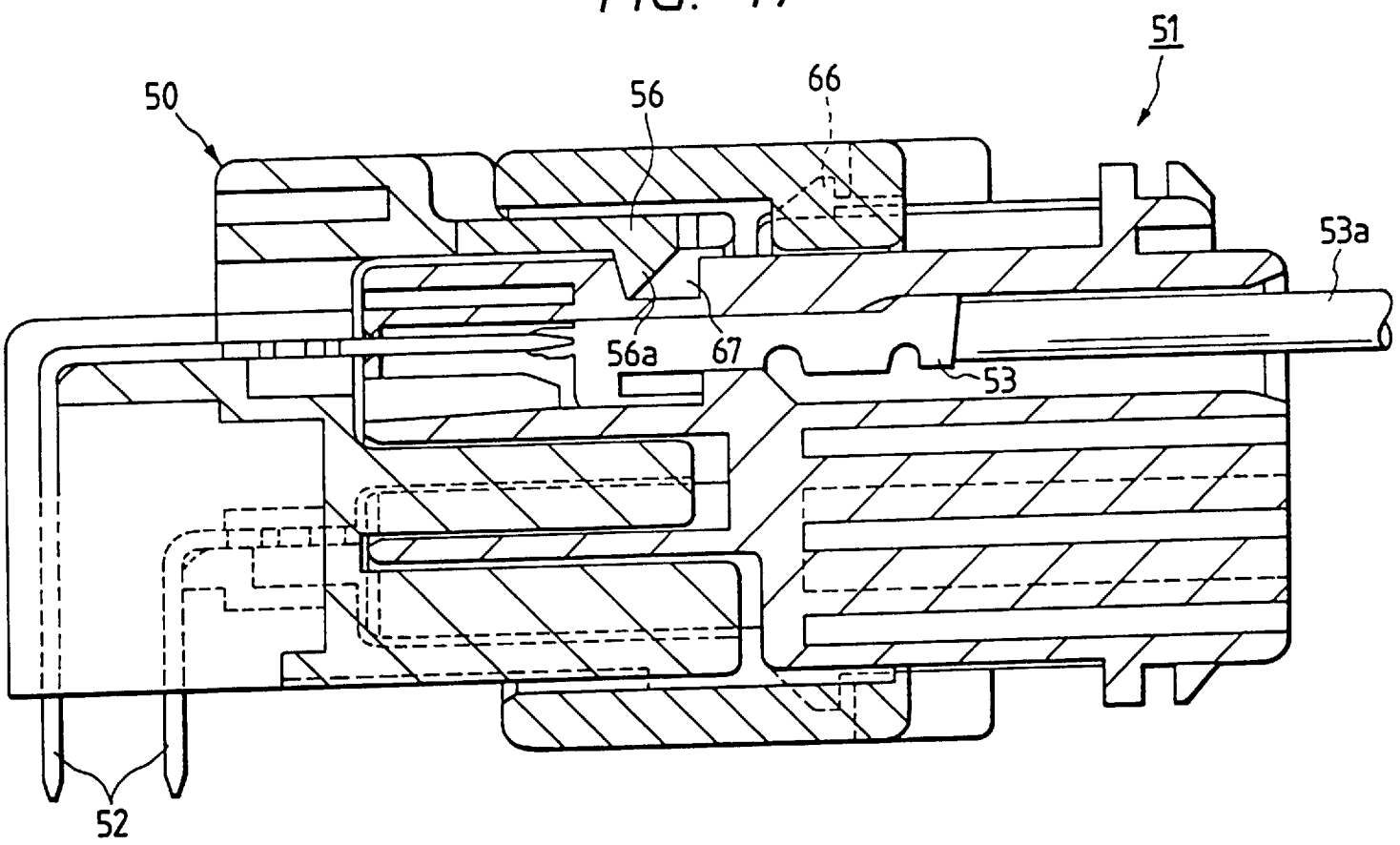
PRIOR ART FIG. 17
FIG. 17 is a vertical cross-sectional view of the connector of FIG. 16 in its fitted condition.
Figure 18:
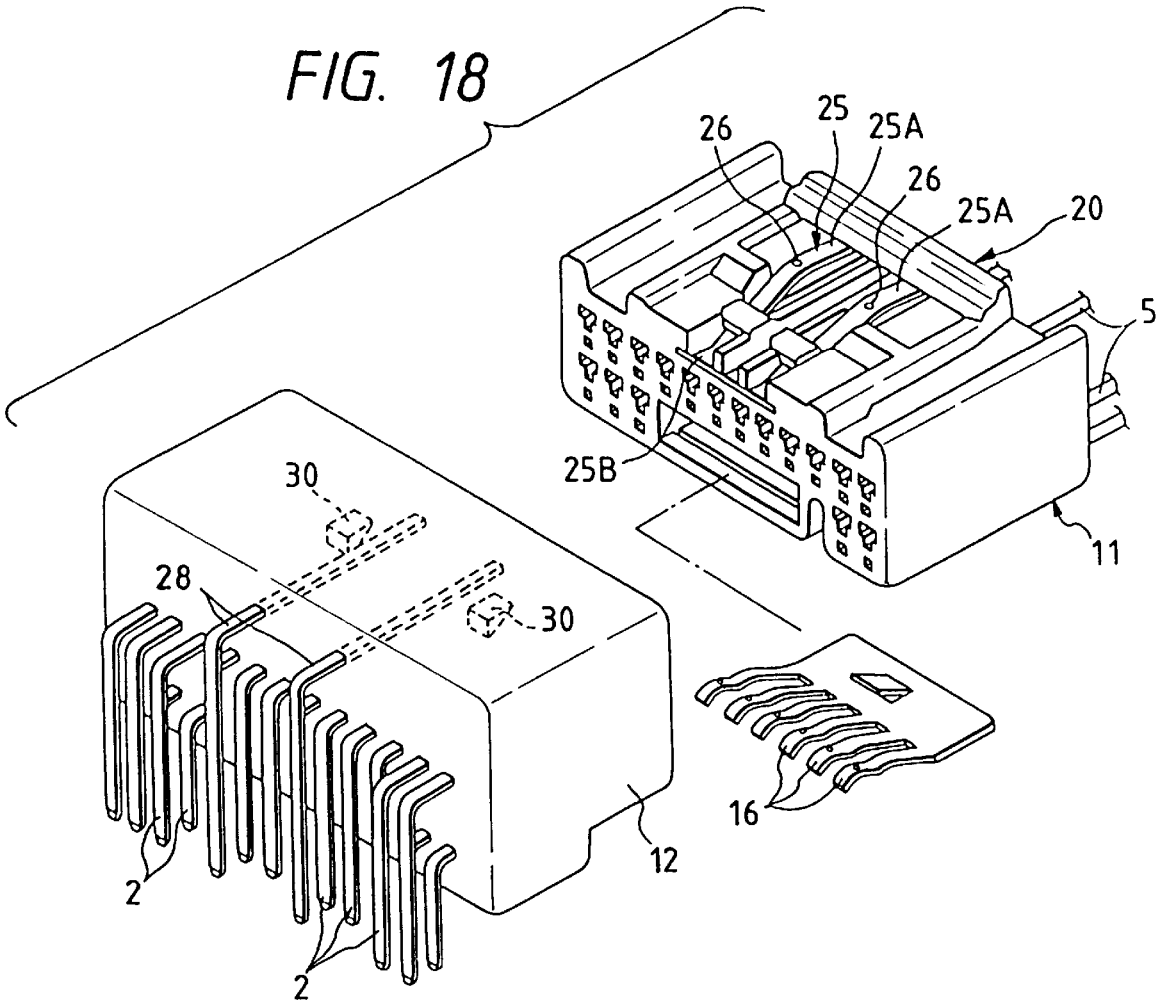
PRIOR ART FIG. 18
FIG. 18 is a perspective view of another conventional connector.
Figure 19:
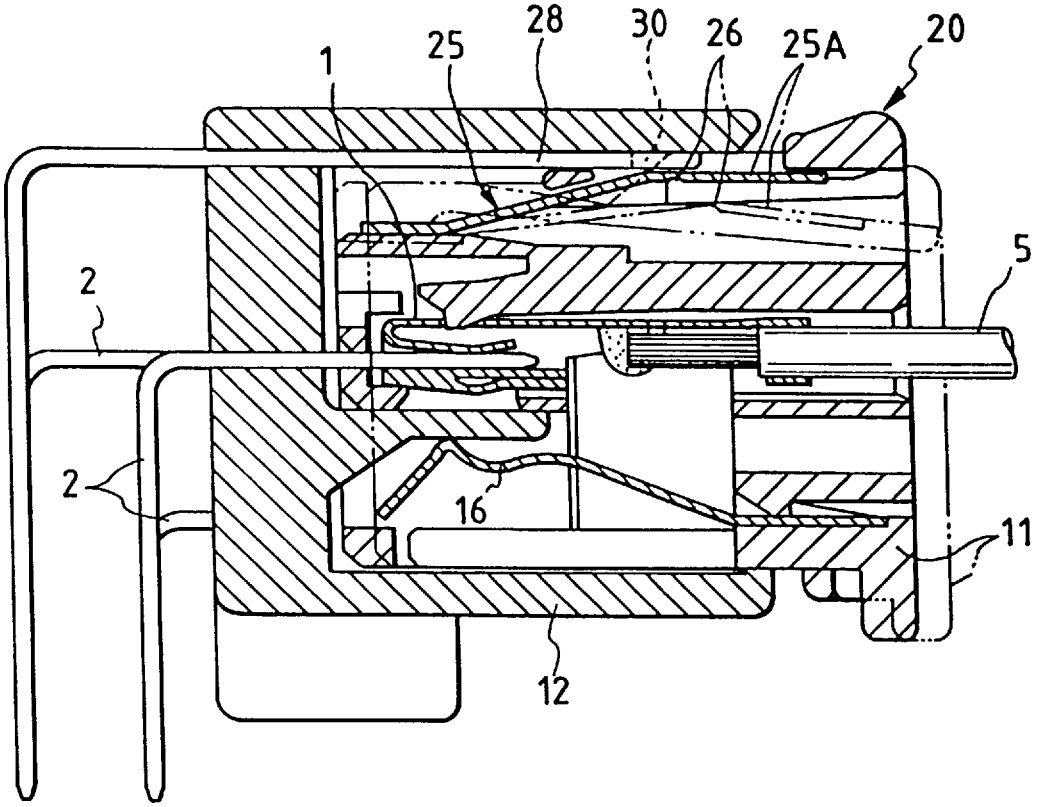
PRIOR ART FIG. 19
FIG. 19 is a vertical cross-sectional view of the connector of FIG. 18 in its fitted condition.

Then, as shown in FIG. 15, the slider 10 is slidingly moved forward under the influence of the compression spring 9, and therefore is returned into its initial condition relative to the body of the female connector 1, and the space for allowing the flexing of the arm portion 8 is eliminated. In this condition, the female and male connectors 1 and 2*a* are completely fitted together, and the male terminals 22 completely contact the female terminals 29, respectively. This completely-fitted condition can be detected by a sense of force obtained when the arm portion 8 slides over the lock beak 25 and by a sense of force obtained when the slider arm 14 slides over the abutment portion 24, and also this completely-fitted condition can be detected by confirming the position of the returned slider 10 with the eyes.

At this time, the fitting detection male terminal 22*a* is inserted into the lower portion of the detection terminal 40, and contacts the contact portion 41 to be short-circuited therewith. As a result, the completely-fitted condition of the female and male connectors 1 and 2*a* can be electrically detected.

The male terminal 22*a* moves in sliding contact with the contact portion 41 of the detection terminal 40, and therefore an oxide film or the like can be removed from those portions of the detection terminal 40 and male terminal 22*a* which contact each other. Therefore, an incomplete electrical conduction of the detection circuit due to an oxide film or the like is prevented.

And besides, since the detection terminal 40 is received in the slider 10, an incomplete electrical conduction due to deposited dust or the like is prevented.

In the half-fitting prevention connector of the present invention, when the female connector is pushed into the male connector, with the slide lock member held against movement, the space for allowing the flexing of the arm portion is formed. Then, the arm portion abuts against the slanting surface of the lock beak, and is flexed downwardly, and the arm portion slides over the lock beak, and is retained by it, and also the slanting surface of the lock beak abuts against the edge of the opening in the slider arm. As a result, the slider arm is flexed upwardly, and the slide lock member is slidingly moved forward under the influence of the resilient member, and is returned to its initial position relative to the female connector, so that the female and male connectors are completely fitted together.

Therefore, in a half-fitted condition, the female and male connectors are moved away from each other by the resiliency of the resilient member, thereby preventing such a half-fitted condition, and besides the fitted condition can be easily detected by a sense of force obtained when the arm portion slides over the lock beak during the fitting operation and also by confirming the position of the slide lock member with the eyes.

For fitting the two connectors together, this fitting operation can be carried out by holding the side wall of the female housing with the hand, and therefore the efficiency of the fitting operation, as well as the efficiency of the disconnecting operation, is enhanced.

In the half-fitting prevention connector of the present invention, the above effects are achieved, and in the completed-fitted condition, the fitting detection male terminal is inserted into the lower portion of the detection terminal, and contacts the contact portion to be short-circuited therewith. Therefore, the completely-fitted condition can be detected electrically, and therefore the reliability of the half-fitting prevention connector is greatly enhanced.

The male terminal moves in sliding contact with the contact portion of the detection terminal, and therefore an oxide film or the like can be removed from those portions of the detection terminal and male terminal which contact each other. Therefore, an incomplete electrical conduction of the detection circuit due to an oxide film or the like is positively prevented.

And besides, since the detection terminal is received in the slide lock member, an incomplete electrical conduction due to the deposition of dust or the like is prevented.

What is claimed is:

1. A half-fitting prevention connector comprising:

a pair of female and male connectors for being fitted and connected together;

a resilient spring member mounted within a housing of one of said two connectors, said resilient spring member being compressed as said two connectors are being fitted together, and a half-fitted condition of said two connectors prevented by resiliency of said resilient spring member, so that the compression of said resilient spring member urges said two connectors away from each other until said two connectors are completely fitted; and a slide lock member slidably supported by an elastically-deformable member, provided on said housing, and a support mechanism, and when fitting said one connector relative to a mating connector, said slide lock member cooperates with said resilient spring member to allow said elastically-deformable member to be elastically deformed so that said elastically-deformable member can be retainingly engaged with the mating connector.

2. A half-fitting prevention connector comprising:

a pair of female and male connectors for being fitted and connected together;

a resilient member mounted within a housing of one of said two connectors, and a half-fitted condition of said two connectors prevented by resiliency of said resilient member mounted within a housing of one of said two connectors; and a slide lock member slidably supported by an elastically-deformable member, provided on said housing, and a support mechanism, and when fitting said one connector relative to a mating connector, said slide lock member cooperates with said resilient member to allow said elastically-deformable member to be elastically deformed so that said elastically-deformable member can be retainingly engaged with the mating connector, wherein said slide lock member includes an elastically-deformable slider arm formed at a front section of an upper portion thereof, a press portion formed at a rear end portion of said upper portion, a spring-receiving portion formed in a rear end portion of a lower base portion, and a receiving space formed between said slider arm and said base portion for receiving said elastically-deformable member, said slider arm having a retaining portion.

3. A half-fitting prevention connector comprising:

a pair of female and male connectors for being fitted and connected together;

a resilient member mounted within a housing of one of said two connectors, and a half-fitted condition of said two connectors prevented by resiliency of said resilient member mounted within a housing of one of said two connectors; and a slide lock member slidably supported by an elastically-deformable member, provided on said housing, and a support mechanism, and when fitting said one connector relative to a mating connector, said slide lock member cooperates with said resilient member to allow said elastically-deformable member to be elastically deformed so that said elastically-deformable member can be retainingly engaged with the mating connector, wherein said elastically-deformable member is a lock arm which includes an elastically-deformable arm portion having a lock hole formed in a central portion thereof, and a lock beak which is formed on an upper surface thereof, and has a slanting surface, and a slider receiving portion for receiving said slide lock member is provided beneath said lock arm.

4. A half-fitting prevention connector according to the claim 1, wherein said support mechanism contains positioning guide grooves provided respectively on opposite sides of a slider receiving portion, and support projections formed respectively on opposite sides of a base portion of said slide lock member.

5. A half-fitting prevention connector according to claim 1, wherein said mating connector has a notch for receiving said slide lock member, and an abutment portion, against which a front end of a slider arm of said slide lock member can abut, is formed on an upper surface of a housing of said mating connector at an end of said notch, and a lock beak for retaining a retaining portion of said slider arm is formed on an inner surface of said housing of said mating connector.

6. A half-fitting prevention connector according to the claim 1, further comprising:

a fitting detection terminal for detecting a fitted condition of said connectors fitted in said slide lock member.

7. A half-fitting prevention connector according to claim 6, wherein said mating connector has a fitting detection male terminal which can be electrically connected to said fitting detection terminal.

8. A half-fitting prevention connector according to the claim 7, wherein said fitting detection terminal has a resilient contact portion for contact with said male terminal, and said contact portion is exposed to a lower side of said fitting detection terminal.

* * * * *